US010125993B2

(12) United States Patent
Beck et al.

(10) Patent No.: US 10,125,993 B2
(45) Date of Patent: Nov. 13, 2018

(54) BURNER, GAS TURBINE HAVING SUCH A BURNER, AND FUEL NOZZLE

(71) Applicant: Siemens Aktiengesellschaft, Munich (DE)

(72) Inventors: Christian Beck, Essen (DE); Stefan Dederichs, Düsseldorf (DE); Olga Deiss, Düsseldorf (DE); Berthold Köstlin, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/126,804

(22) PCT Filed: Mar. 20, 2015

(86) PCT No.: PCT/EP2015/055881
§ 371 (c)(1),
(2) Date: Sep. 16, 2016

(87) PCT Pub. No.: WO2015/150114
PCT Pub. Date: Oct. 8, 2015

(65) Prior Publication Data

US 2017/0108224 A1 Apr. 20, 2017

(30) Foreign Application Priority Data

Apr. 3, 2014 (DE) ..... 10 2014 206 446

(51) Int. Cl.
*F23R 3/36* (2006.01)
*F23R 3/28* (2006.01)

(52) U.S. Cl.
CPC ..... *F23R 3/36* (2013.01); *F23R 3/286* (2013.01); *F23R 2900/00002* (2013.01)

(58) Field of Classification Search
CPC ..... F23D 17/00; F23D 14/24; F23D 14/58; F23R 3/36
See application file for complete search history.

(56) References Cited

U.S. PATENT DOCUMENTS 3,319,692 A * 5/1967 Imants ..... F23C 9/00 239/DIG. 7
3,974,646 A * 8/1976 Markowski ..... F02K 3/10 244/200.1

(Continued)

FOREIGN PATENT DOCUMENTS

DE 4426351 A1 2/1996
DE 10205428 A1 9/2003

(Continued)

OTHER PUBLICATIONS

DE Search Report, dated Dec. 12, 2014, for DE application No. 102014206446.5.

(Continued)

*Primary Examiner* — Andrew Nguyen
*Assistant Examiner* — Stephanie Cheng
(74) *Attorney, Agent, or Firm* — Beusse Wolter Sanks & Maire

(57) ABSTRACT

A burner having a plurality of pre-mixing chambers each having a fuel nozzle for two fuels, the fuel nozzle has a fuel lance extending in a flow direction, in which fuel lance first outlet openings for a first fuel are introduced. The fuel lance is surrounded by an outer pipe having at least one second outlet opening for a second fuel, the first outlet openings oriented radially and the second outlet opening oriented axially, a flow cross-section is formed between the fuel lance and the inside of the pre-mixing chamber and vortex generators are arranged on the fuel lance. At least one vortex generator is arranged upstream of the first outlet openings and downstream of the second outlet opening. The distance (Continued)

of the first outlet openings from an end of the pre-mixing chamber is at least three times as large as a cross-section of the pre-mixing chamber.

13 Claims, 8 Drawing Sheets

(56) References Cited

U.S. PATENT DOCUMENTS

| | | | | |
|---|---|---|---|---|
| 4,260,367 | A * | 4/1981 | Markowski | F23R 3/346 431/158 |
| 4,311,277 | A | 1/1982 | Stratton | |
| 4,850,194 | A * | 7/1989 | Fuglistaller | F23D 11/00 60/737 |
| 4,974,415 | A * | 12/1990 | Shekleton | F02K 9/64 60/733 |
| 5,235,813 | A * | 8/1993 | McVey | F23R 3/12 431/181 |
| 5,435,126 | A | 7/1995 | Beaudoin | |
| 5,626,017 | A | 5/1997 | Sattelmayer | |
| 7,610,761 | B2 * | 11/2009 | Carroni | B01F 5/0453 60/723 |
| 2002/0014078 | A1 | 2/2002 | Mandai et al. | |
| 2005/0037305 | A1 | 2/2005 | Moriya et al. | |
| 2010/0287940 | A1 | 11/2010 | Ciani et al. | |
| 2010/0300109 | A1 * | 12/2010 | Carroni | F23L 7/00 60/776 |
| 2015/0000285 | A1 | 1/2015 | Deiss et al. | |
| 2016/0033135 | A1 * | 2/2016 | Chen | F23R 3/286 60/776 |

FOREIGN PATENT DOCUMENTS

| | | | | |
|---|---|---|---|---|
| EP | 2604919 | A1 * | 6/2013 | F02C 7/22 |
| EP | 2253888 | B1 | 10/2013 | |
| JP | 2001141242 | A * | 5/2001 | |

OTHER PUBLICATIONS

International Search Report, dated Aug. 21, 2015, for PCT application No. PCT/EP2015/055881.

* cited by examiner

BURNER, GAS TURBINE HAVING SUCH A BURNER, AND FUEL NOZZLE

CROSS REFERENCE TO RELATED APPLICATIONS

This application is the U.S. National Stage of International Application No. PCT/EP2015/055881 filed Mar. 20, 2015, and claims the benefit thereof. The International Application claims the benefit of German Application No. DE 102014206446.5 filed Apr. 3, 2014. All of the applications are incorporated by reference herein in their entirety.

FIELD OF INVENTION

The invention relates to a burner with a premixing chamber and with a fuel nozzle for two fuels. Furthermore, the invention relates to a gas turbine with such a burner. Furthermore, the invention relates to a fuel nozzle for two fuels.

BACKGROUND OF INVENTION

In gas turbines a burner is typically provided with a premixing chamber, in which a fuel, in particular in gaseous form, is mixed with air, in order then to combust the resultant mixture. The efficiency of the gas turbine and also the formation of undesired emission products, in particular nitrogen oxides, are in this case essentially dependent on proper mixing of the fuel with the air.

In particular in a gas turbine operated with natural gas, the natural gas is frequently injected radially, i.e. perpendicular to the direction of air flow (the "jet in crossflow" method). In this way, appropriate mixing of natural gas and air can be achieved.

"Vortex generators" are additionally known for mixing, for example from DE 44 26 351 A1, in which a combustion chamber is disclosed which consists substantially of a first stage and a second stage arranged downstream in the direction of flow. In this case, the first stage comprises a mixer on the head side for forming a fuel/air mixture and vortex generators are present on the outflow side of the mixer. These serve in particular to swirl hot air, which is then guided into a premixing zone for mixing with fuel and then into a combustion zone of the second stage.

It is additionally known to operate gas turbines with a plurality of fuels, for example with natural gas and hydrogen. Operation may proceed either simultaneously with a plurality of fuels or with just one of the fuels. This in particular increases the flexibility of the gas turbine, since fuels may be used according to availability. However, the different operating modes also result in additional requirements for the gas turbine and the burners thereof.

When using or admixing hydrogen, however, there is an increased risk, over the use of just natural gas, of flareback and self-ignition. To reduce this risk, it is possible to add a less reactive gas to the hydrogen to form a hydrogen-containing fuel gas, which frequently however disadvantageously has a lower energy density than natural gas. It is thus in particular necessary to design injection so as to be suitable to accommodate different volumetric flow rates for the different fuels.

To reduce further the risk of flareback and self-ignition, it is known to inject the hydrogen-containing fuel gas in a coaxial direction, i.e. in the direction of air flow. In this way, an air-side pressure drop is in particular also reduced, this being greater when hydrogen-containing fuel gas is used, due to the greater volumetric flow rate, than when natural gas is used.

EP 2 604 919 A1 for example discloses a fuel nozzle for two fuels, with an inner pipe with radially oriented outlet orifices for a first fuel and with an outer pipe surrounding the inner pipe and having axially oriented outlet orifices for a second fuel. Using such a nozzle it is possible, for example, to inject a hydrogen-containing fuel gas in the direction of air flow via the axial outlet orifices. To improve mixing of the fuel gas with the air, a "lobe mixer" is additionally provided. The second fuel, for example natural gas, is then injected via the radial outlet orifices. A disadvantage here is that there are no further options for optimizing mixing in particular of the natural gas and the air.

SUMMARY OF INVENTION

An object of the invention is to provide an improved burner, which in particular is suitable for operation with a plurality of fuels. It is additionally intended to improve mixture formation in the burner. It is further intended to provide a gas turbine with such a burner. In addition, it is intended to provide an improved fuel nozzle, which is suitable in particular for a plurality of fuels.

The object is achieved according to the invention by a burner, a gas turbine having and a fuel nozzle having the features of the independent claims. Advantageous configurations, further developments and variants constitute the subject matter of the subclaims.

To this end, provision is made for a burner to comprise a plurality of premixing chambers each with a fuel nozzle for two fuels, wherein the fuel nozzle has a fuel lance extending in a flow direction into which a number of first outlet orifices for a first fuel are introduced, and the fuel lance is surrounded by an outer pipe with at least one second outlet orifice for a second fuel, wherein the first outlet orifices are oriented radially and the second outlet orifice is oriented axially, wherein a flow cross section is formed between the fuel lance and the inside of the premixing chamber and wherein a number of vortex generators are arranged on the fuel lance which reduce a flow cross section oriented transversely to the direction of flow, wherein at least one vortex generator is arranged upstream of the first outlet orifices and downstream of the second outlet orifice and the premixing chamber has a cross section and an end and the distance between the first outlet orifices and the end of the premixing chamber is at least three times as great as the cross section of the premixing chamber. In particular, the premixing chamber comprises an air inflow channel, in which the fuel nozzle is arranged. Advantageously, air flows in the direction of flow, for mixing with the first and/or second fuel.

The air, the first fuel and the second fuel are hereinafter denoted in general as gases. Use is in principle not restricted to gaseous media, however. Furthermore, use is not restricted to the gases stated below, namely natural gas, hydrogen and air.

The fuel lance advantageously serves in the injection of natural gas, which is provided by means of the radial outlet orifices for mixing purposes. Radial is here understood to mean that the fuel lance extends in the direction of flow, i.e. axially, and, radially thereto, has a circumferential surface into which suitable, for example round, orifices are introduced. In this way, in particular a "jet in crossflow" mixture is produced, in which fuel inflow is substantially perpendicular to the air.

The outlet orifices are advantageously at a common position in the axial direction and regularly distributed in the circumferential direction of the fuel lance. Alternatively, however, another suitable arrangement is selected. For example, outlet orifices are arranged one behind the other at multiple positions in the axial direction.

The outer pipe, which surrounds the fuel lance, likewise extends in the direction of flow, i.e. in the axial direction. In this case, the outer pipe advantageously only partly surrounds the fuel lance in the axial direction, i.e. the fuel lance protrudes in the direction of flow. This makes it possible, in particular, to arrange the radial outlet orifices outside a region of the fuel lance covered by the outer pipe, so in particular improving mixing with air. Alternatively, the radial outlet orifices are however covered by the outer pipe or both covered and uncovered outlet orifices are present.

The outer pipe advantageously serves for axial injection of the second fuel, for example hydrogen or a hydrogen-containing fuel gas. As a result of the axial injection, it is in particular possible to inject a fuel with a volumetric flow rate which is greater compared with natural gas. Advantageously, moreover, an air-side pressure drop, as may be present in the case of radial injection, may be reduced or avoided completely.

To improve intermixing of two of the gases or all the gases, at least one vortex generator is provided, i.e. arranged in the burner. Mixing can in particular be achieved by means of the vortex generator in that a flow cross section of at least one of the gases is reduced at at least one position in the direction of flow.

For example, the air flows in the direction of flow at a first position through a first area, which is oriented transversely, i.e. substantially perpendicular to the direction of flow. The first area here corresponds to the flow cross section at the first position. A vortex generator is for example arranged at a second position downstream of the first position, resisting the air with an additional blocking surface, whereby the second area through which the air flows at the second position is smaller than the first area. In other words, the flow cross section is smaller at the second position than at the first position. For example, the vortex generator is a surface angled relative to the direction of flow. In this case, the vortex generator appropriately has a contour, advantageously at least one edge, for generating turbulence. This serves in particular in mixing the then swirled gas with a second gas. Conveniently, mixing of the first and/or second fuel with air and/or intermixing of the fuels is hereby improved. Overall, therefore, as a result of the arrangement of the vortex generators, during operation efficient mixing of the gases is achieved in the case of a multi-substance fuel nozzle due to the turbulence generated, irrespective of the respective operating mode, i.e. which gas is currently being used as fuel.

In the case of the burner according to the invention, at least one vortex generator is mounted on the fuel lance. When in particular the vortex generator is used to swirl the first fuel injected by means of the fuel lance, the vortex generator is advantageously adapted to the requirements of this fuel. In the event of changeover of the first fuel and thus possibly modified requirements with regard to mixing with air, it is thereby in particular possible, through changeover of the fuel lance, simultaneously to change the vortex generator.

Furthermore, in the case of the burner according to the invention, at least one vortex generator is arranged upstream of the radial outlet orifices and downstream of the axial outlet orifice. In this way, swirling of the air and/or of the second fuel may in particular be achieved without the vortex generator directly influencing flow of the first fuel. Direct influencing is here understood to mean that the gas influenced by the vortex generator in question flows thereagainst.

Finally, the premixing chamber of the burner according to the invention comprises a cross section and an end, wherein, with regard to good intermixing of fuel and air, the distance between the first outlet orifices and the end of the premixing chamber is at least three times as great as the cross section of the premixing chamber. In this way, it is ensured that the length of the path over which the fuel and air are able to mix is sufficiently great.

In a configuration, the fuel lance and the outer pipe are arranged concentrically. In particular, the fuel lance and the outer pipe are substantially cylindrical in form and have a common longitudinal axis. The outer pipe is in this case advantageously configured as a pipe with an annular profile across the longitudinal axis. The longitudinal axis conveniently extends in the direction of flow. In particular, the second fuel and the air each flow in the direction of flow. In other words, the air and the second fuel flow in or are injected axially. In contrast, the first fuel is advantageously injected radially.

In one suitable embodiment, at least one vortex generator is wedge-shaped in form. Wedge-shaped is here understood to mean that the vortex generator has a surface which extends obliquely relative to the axial direction and in particular obliquely relative to the direction of flow. The surface is for example of rectangular configuration. Alternatively, the surface is of triangular configuration, wherein one side of the triangle extends transversely to the direction of flow. The remaining two sides taper towards the point of the triangle either in or contrary to the direction of flow. Wedge-shaped is in particular also understood to mean tetrahedral.

Instead of a wedge-shaped configuration, other geometric shapes are also suitable. The vortex generator is also possibly configured as a solid body or composed of various surface elements or indeed of multipart configuration. What is essential is that the flow cross section is adjustable in the direction of flow by means of the vortex generator, in particular in order to generate turbulence in the flow profile of the gas flowing against the vortex generator. Adjustable is here in particular understood to mean that the precise configuration and orientation of the vortex generator is established on production and installation thereof.

In one advantageous configuration, at least one vortex generator is mounted on the outer pipe. The vortex generator is here mounted either on the outside on the outer pipe, in particular for swirling the air flowing appropriately therealong, or on the inside in the outer pipe, for swirling the second fuel advantageously flowing therealong.

In a further advantageous configuration, the premixing chamber comprises an internal wall, on which at least one vortex generator is mounted. In this way it is possible in particular to achieve swirling that is substantially independent of the fuel nozzle.

In a further advantageous configuration, at least one vortex generator is arranged downstream of the radial outlet orifices. In other words, at least one vortex generator is arranged downstream of each outlet orifice, whereby this vortex generator in particular influences, i.e. in particular swirls, each of the gases which have flowed in.

Several or all of the above-stated configurations relating to the positioning of the vortex generator are combined in a further advantageous configuration. In this way, the correspondingly stated advantages are in particular also combined. For example, at least one vortex generator is arranged downstream of the axial outlet orifice and upstream of the radial outlet orifices and on the fuel lance. Alternatively or in addition, a plurality of vortex generators are for example arranged at various positions on the fuel lance in the axial direction.

It is furthermore possible advantageously to arrange a plurality of vortex generators in groups, for example in series, one behind the other or offset in the axial direction; or in a plane, i.e. in particular both next to one another (for example in the circumferential direction) and one behind the other. It is also possible for a plurality of vortex generators advantageously to have different geometries and/or dimensions.

A plurality of vortex generators are advantageously arranged at approximately the same position in the axial direction and in a circumferential direction with regard to the longitudinal axis. For example, a plurality of vortex generators are arranged in such a way around the circumference of the outer pipe that all the distances between adjacent vortex generators in the circumferential direction are of equal magnitude.

In particular, it is advantageously possible to influence paired swirling of the various gases by a suitable combination of multiple, in particular different vortex generators. For example, a number of vortex generators are mounted on the outer pipe for swirling the air and for improved mixing with hydrogen injected axially downstream thereof. In order further to optimize the swirling of natural gas with air, vortex generators are for example additionally mounted downstream of the radial outlet orifices.

In an advantageous further development, the outer pipe comprises an end region which is configured as a lobe mixer and comprises a number of lobes. These extend in particular in the direction of flow and as radially configured folds. This results, transversely of the longitudinal axis, in particular in a stellate cross section (or indeed a stellate profile). In the circumferential direction, an interspace is formed between each pair of lobes, by means of which in particular the flow cross section of the air is advantageously increased downstream.

The lobes each comprise a vertex in the radial direction, which extends substantially in the axial direction. This means in particular that the radial distance between vertex and longitudinal axis is substantially constant in the direction of flow. In particular, the outer pipe comprises an outer jacket and the vertices of the lobes are substantially in line with the outer jacket. It is then possible for a slight inclination or slope to be provided in the axial direction.

Mixing of the second fuel with air is advantageously achieved in that the air follows the direction of flow and stalls at the end of the end region. In particular, the stellate cross section of the end region comprises a contour line extended relative to the outer pipe (and correspondingly stellate). In this way, an edge larger than the circumference of the outer pipe is advantageously provided for stalling.

In a suitable further development, the end region is turned or twisted in such a way that the lobes and thus also the vertices extend in a spiral around the longitudinal axis. This makes it possible additionally to swirl the air flowing past the lobes and thus to achieve improved mixing.

In a further suitable further development, a number of the lobes are additionally configured as vortex generators. To this end, these lobes are in particular shaped in such a way that the vertices thereof are configured as surfaces extending obliquely in the axial direction. In other words, the distance from the vertex of a lobe to the longitudinal axis varies in the direction of flow. Advantageously, the distance is enlarged continuously in the direction of flow. In this way, an angled surface with an edge is in particular created, in such a way that swirling in the manner of a vortex generator may be achieved thereby.

In an advantageous further development, at least one vortex generator is arranged in an interspace between two lobes. The stated interspace here corresponds to the interspace already mentioned above between two neighboring lobes in the circumferential direction of the outer pipe. This arrangement in particular makes it possible to produce vortex generators with comparatively large lateral surfaces, i.e. in comparison with vortex generators arranged for example on an annular pipe without lobe mixer. Swirling can advantageously be influenced in this way.

A combination of the above-stated vortex generators with one of the above-stated designs for injecting the second fuel conveniently allows improved mixing of the gases concerned. Advantageously, mixing is improved both in the case of simultaneous injection of the first and second fuel (for example natural gas and hydrogen) and in the case of individual operation, i.e. injection of just one fuel (for example natural gas or hydrogen).

A gas turbine advantageously comprises a burner with one or more of the above-stated features, resulting in the advantages accordingly stated above. Such a gas turbine is additionally particularly efficient and advantageously has lower pollutant emissions.

A fuel nozzle for two fuels appropriately comprises a fuel lance extending in a direction of flow. A number of first outlet orifices for a first fuel are introduced thereinto. The fuel lance is then surrounded by an outer pipe with at least one second outlet orifice for a second fuel, wherein the first outlet orifices are oriented radially and the second outlet orifice axially, wherein a number of vortex generators are arranged on the fuel lance. At least one vortex generator is arranged upstream of the first outlet orifices and downstream of the second outlet orifice.

BRIEF DESCRIPTION OF THE DRAWINGS

Exemplary embodiments of the invention are explained in greater detail below on the basis of drawings, in which.

DETAILED DESCRIPTION OF INVENTION

Figure 1:
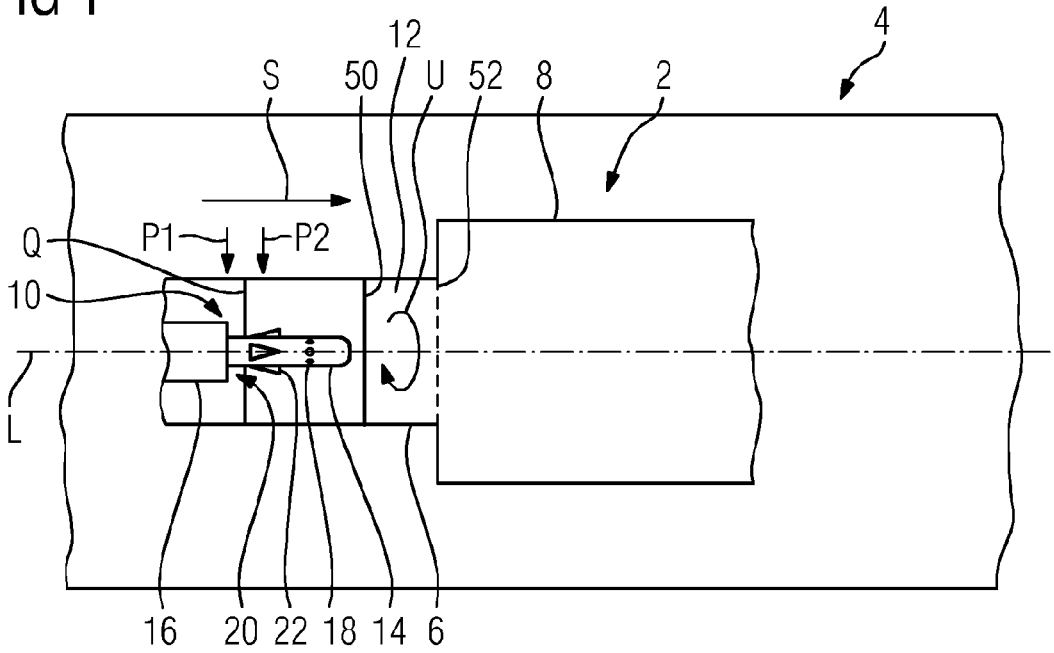
FIG. 1 is a side view of a burner with a fuel nozzle for two fuels and a plurality of vortex generators mounted on the fuel nozzle.
Figure 2:
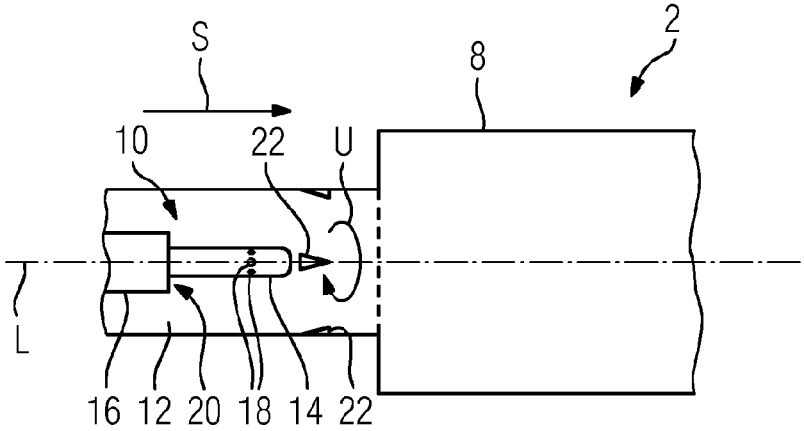
FIG. 2 shows the burner according to FIG. 1 with an alternative fuel nozzle and a premixing chamber, on the internal walls of which a plurality of vortex generators are mounted.

A schematic representation of a burner 2, in particular for a gas turbine 4, is shown by each of FIGS. 1 and 2. The burner 2 here comprises a premixing chamber 6, downstream of which in the direction of flow S is arranged a combustion chamber 8. In the exemplary embodiment shown here, two fuels and air are injected into the premixing chamber 6 when in operation. A fuel nozzle 10, which extends in the direction of flow S, serves to inject the fuels. The air flows in the direction of flow S via an air inlet channel 12 surrounding the fuel nozzle 10.

The fuel nozzle 10 comprises a fuel lance 14 and an outer pipe 16 surrounding said lance, wherein the fuel lance 14 protrudes in the direction of flow S and relative to the outer pipe 16. The fuel lance 14 and the outer pipe 16 are substantially cylindrical in the embodiment shown here, i.e. they have a circular or annular cross section transversely of the direction of flow S. In particular, the fuel lance 14 and the outer pipe 16 are arranged concentrically and accordingly have a common longitudinal axis L which extends in the direction of flow S.

The fuel lance 14 comprises a number of radial outlet orifices 18. These are embodied in circular manner in the exemplary embodiment shown here and arranged at a common position in the axial direction, i.e. in the direction of flow S. The outlet orifices 18 are here distributed in a circumferential direction U, in particular regularly. The radial outlet orifices 18 serve in particular to inject the first fuel, for example natural gas.

The outer pipe 16 has a larger diameter than the fuel lance 14, so forming in the axial direction an in particular annular, axial outlet orifice 20. This is used to inject the second fuel into the premixing chamber 6. In other words, the second fuel in particular also flows around the fuel lance 14.

In FIG. 1 a number of vortex generators 22 are attached to the fuel lance 14. These are arranged downstream of the axial outlet orifice 20 and upstream of the radial outlet orifices 18. In the exemplary embodiment shown here, the vortex generators 22 are tetrahedral in form (cf. in particular also FIG. 20).

FIG. 1 additionally shows that the premixing chamber 6 has a cross section 50 and an end 52 and the distance between the first outlet orifices 18 and the end 52 of the premixing chamber 6 is at least three times as great as the cross section 50 of the premixing chamber 6.

In an alternative or supplementary configuration according to FIG. 2, the vortex generators 22 according to FIG. 1 are fastened to the internal walls of the premixing chamber 6. In this case, the vortex generators 22 are arranged at a position downstream of the radial outlet orifices.

In the two exemplary embodiments shown in FIGS. 1 and 2, the vortex generators 22 each have a surface 24 angled relative to the direction of flow S, which surface is triangular here and tapers along the longitudinal axis L contrary to the direction of flow S. This arrangement is also designated as being directed forwards. In an alternative embodiment not shown here, the vortex generators 22 are in contrast directed backwards, i.e. turned through 180° in such a way that the surface 24 tapers along the longitudinal axis L in the direction of flow S.

As a result of the surface 24, here in particular in each case two edges 26 are formed, at which in particular swirling is generated during operation. In addition, a flow cross section Q, which is modified by the vortex generators 22 in the direction of flow S, is defined transversely of the direction of flow S in particular by the premixing chamber 6 and the elements arranged therein. In FIG. 1 for example, the flow cross section Q is defined at a first position P1 by the premixing chamber 6 and the fuel lance 14. At this first position P1, the flow cross section Q is in particular greater than at a second position P2, at which the vortex generators 22 are arranged in the exemplary embodiment shown here. It is advantageously possible to adjust the flow cross section Q by appropriate configuration of the vortex generators 22 and thus in particular appropriately to influence the mixing of the gases.

FIGS. 3 to 17 are schematic representations of further exemplary embodiments of a fuel nozzle 14. FIGS. 3, 6, 9, 12 and 15 each show the fuel nozzle 14 in side view, arrows indicating an inflow direction 28, 30, 32 for each of the gases. In this case, the first fuel flows in radially in the inflow direction 28 and the second fuel and the air flow in axially in the inflow directions 30, 32. As a result of the axial inflow, in the premixing chamber 6 in particular the general direction of flow S is established, which the first fuel also substantially adopts at a sufficient distance from the radial outlet orifices 18.

FIGS. 4, 7, 10, 13 and 16 each show the corresponding fuel lance 14 in front view, and FIGS. 5, 8, 11, 14 and 17 each show the corresponding fuel lance 14 in perspective view.

Figure 3:
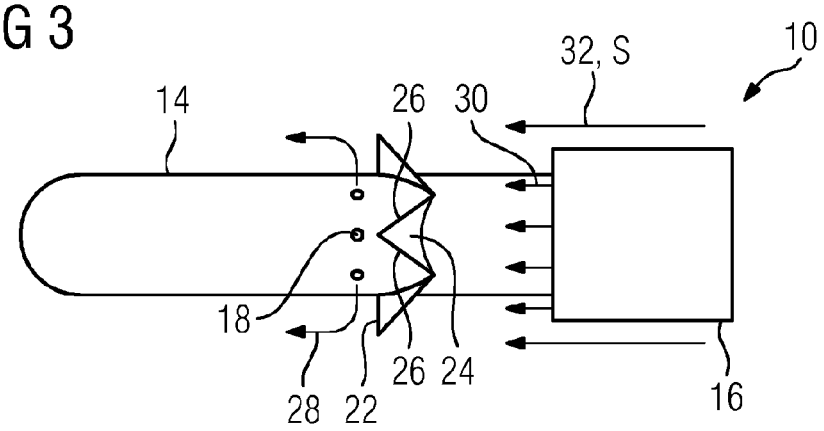
FIGS. 3 to 17 show further exemplary embodiments of the fuel nozzle according to FIG. 1, wherein the fuel nozzle is shown in each of FIGS. 3, 6, 9, 12 and 15 in side view, in each of FIGS. 4, 7, 10, 13 and 16 in front view and in each of FIGS. 5, 8, 11, 14 and 17 in perspective view, and FIGS. 18 to 23 each show an exemplary embodiment of a vortex generator in perspective view.
Figure 4:
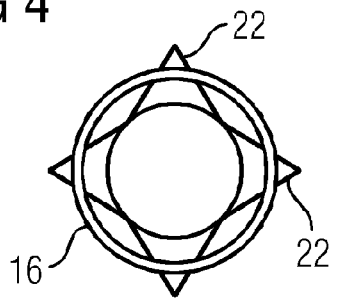
Figure 5:
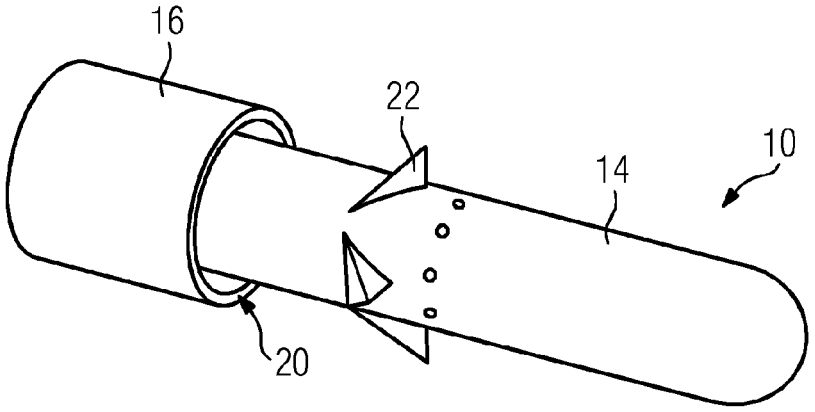

The embodiment of the fuel nozzle 10 shown in FIGS. 3 to 5 comprises a number of forwards-oriented tetrahedral vortex generators 22, which are mounted on the fuel lance 14 downstream of the axial outlet orifice 20 and upstream of the radial outlet orifices 18. Here, the vortex generators 22 each have a height H which is here selected such that the vortex generator 22 extends further in the radial direction than the outer pipe 16. This is shown particularly clearly in FIG. 4. This makes it possible in particular for air to flow directly against the vortex generators 22 and be swirled.

Figure 6:
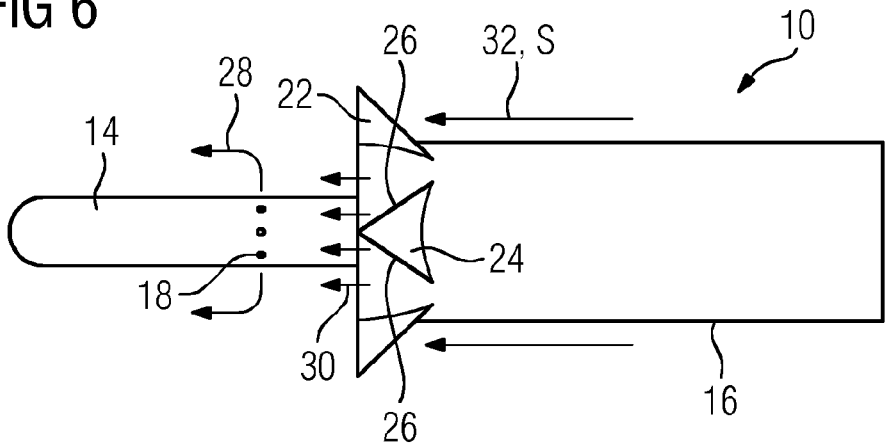
Figure 7:
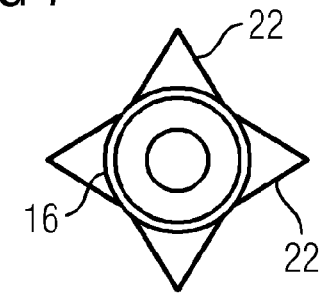
Figure 8:
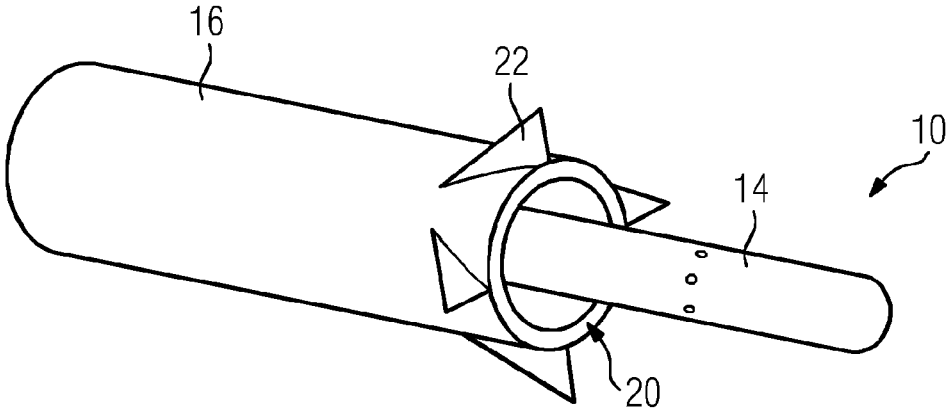

FIGS. 6 to 8 show the fuel nozzle 10 with vortex generators 22 mounted on the outer pipe 16. These are here oriented forwards, the air which has flowed in around the outer pipe 16 flowing against them. The fuel lance 14, in contrast, does not comprise any vortex generators 22.

Figure 9:
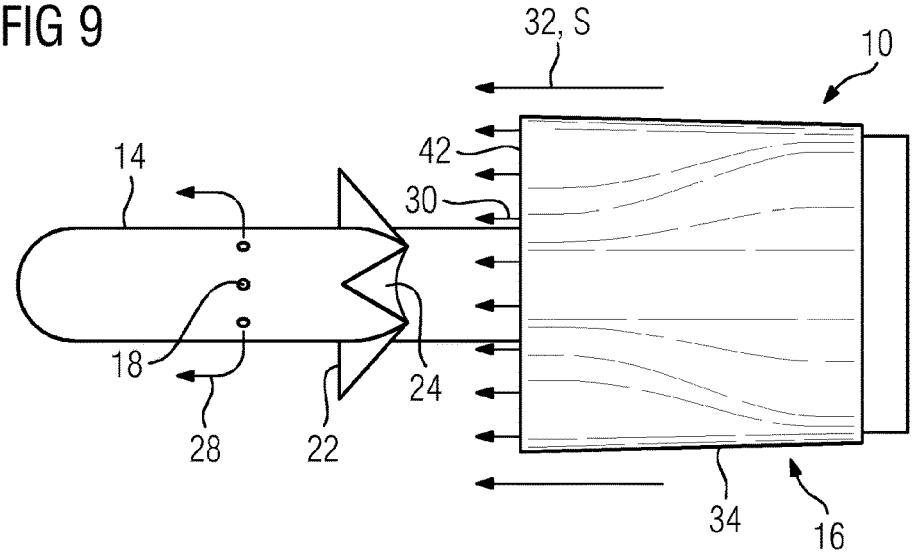
Figure 10:
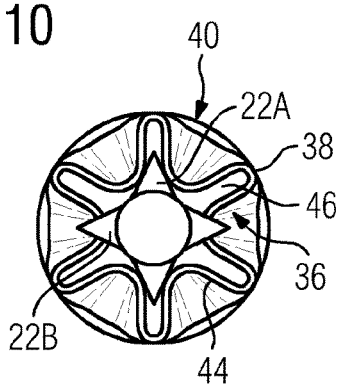
Figure 11:
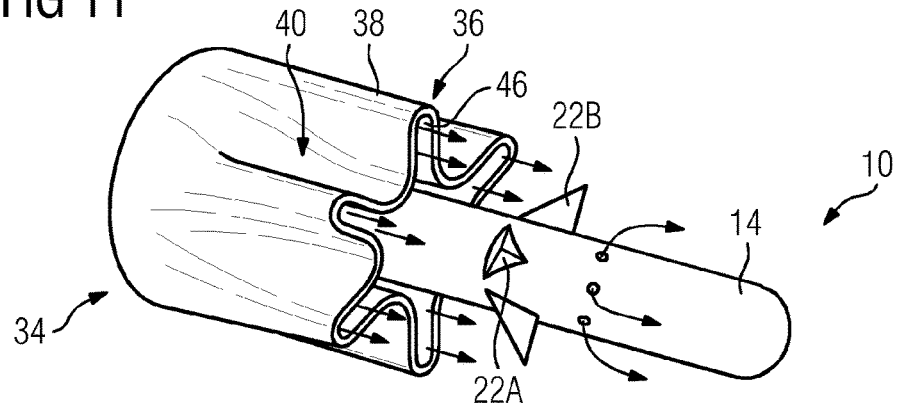

FIGS. 9 to 11 show the fuel nozzle 10 with an end region 34 configured as a lobe mixer. To this end, a number of lobes 36, six in this case, are formed in the end region 34. These result in a stellate cross section, as is clear for example from FIG. 10. FIG. 10 further shows that the lobes 36 substantially do not project beyond the outer pipe 16 in the radial direction.

The lobes 36 each have a vertex 38 extending in the axial direction and are spaced apart in particular regularly in the circumferential direction U by interspaces 40. At the end 42 of the outer pipe 16, the lobes 36 form a contour 44 which here is stellate and by which in particular also a number of outlet channels 46 are created. The axial outlet orifice 20 therefore comprises six outlet channels 46 in the exemplary embodiment shown here.

As FIGS. 10 and 11 show, the vortex generators 22 mounted downstream on the fuel lance 14 may either be aligned in the direction of flow S with one of the outlet channels 46 or be offset relative thereto. Of the four vortex generators 22 present here, for example two vortex generators 22A are arranged as notional extensions of outlet channels 46 and two vortex generators 22B are arranged as notional extensions of interspaces 40. As a result of an arrangement in particular configured in this way, it is possible to use the respective vortex generators 22 either principally to swirl the air flowing through an interspace 40 or principally to swirl the second fuel flowing through an outlet channel 46.

Figure 12:
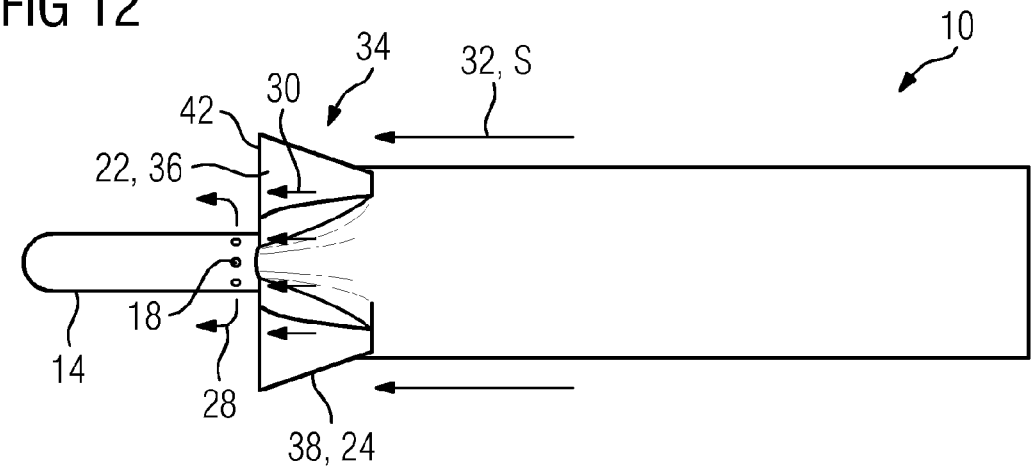
Figure 13:
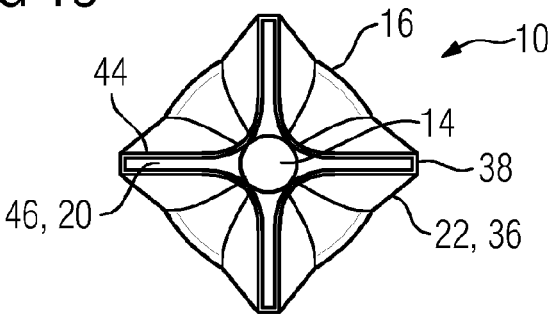
Figure 14:
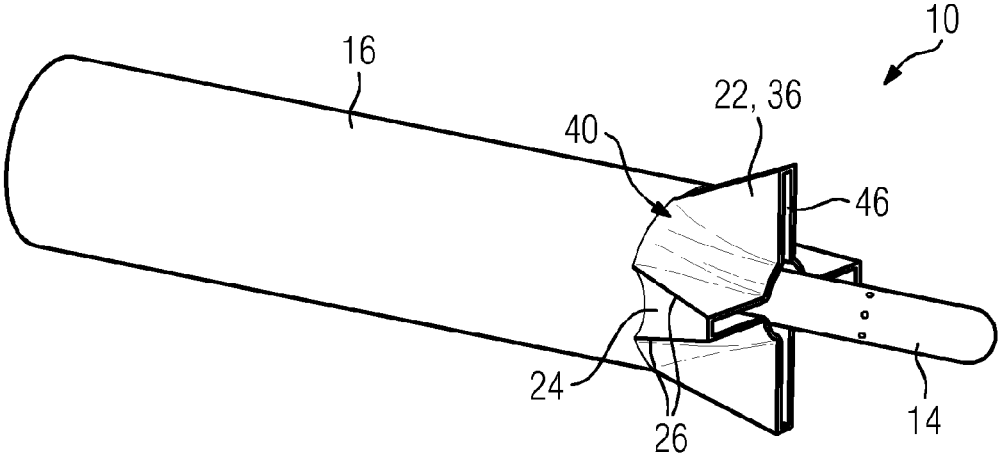

FIGS. 12 to 14 show an exemplary embodiment in which the outer pipe 16 of the fuel nozzle 10 has in the end region 34 a number of lobes 36, here four, which are embodied at the same time as vortex generators 22. The respective vertex 38 of a lobe 36 is configured as an angled surface 24 and has two edges 26 delimiting the substantially triangular surface 24. These extend away from the longitudinal axis L in the downstream direction. The end region 34 has a number of outlet channels 46 for the second fuel corresponding to the number of vortex generators 22.

Furthermore, in the exemplary embodiment shown here the radial outlet orifices 18 are arranged substantially directly downstream of the outer pipe 16. A respective radial outlet orifice 18 is here arranged either as a notional extension of an interspace 40 or as a notional extension of an outlet channel 46.

Figure 15:
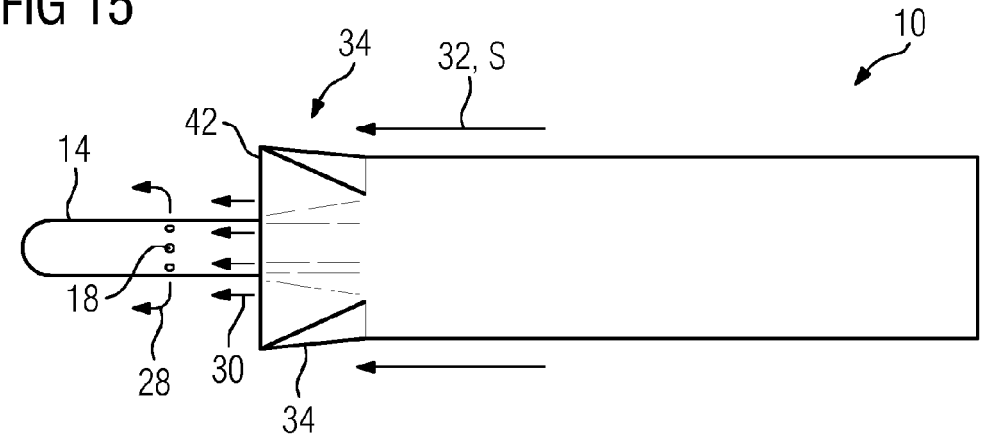
Figure 16:
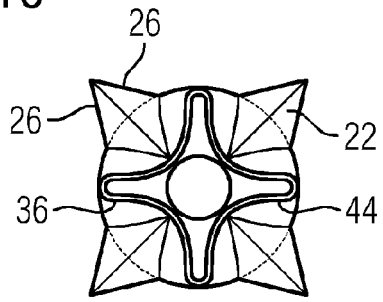
Figure 17:
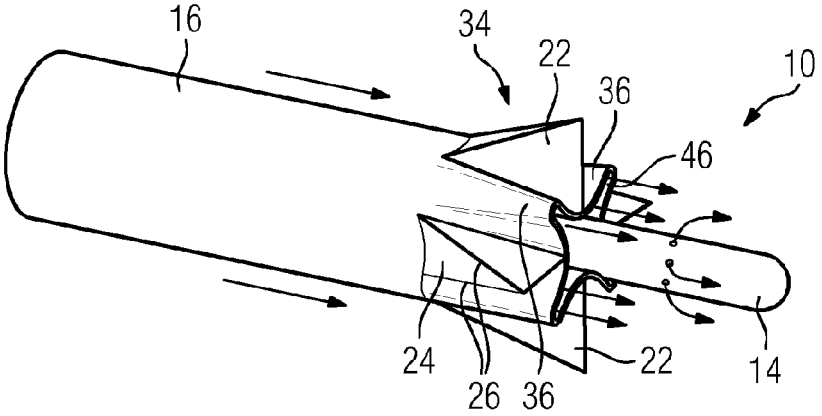

An alternative embodiment with both vortex generators 22 and lobes 36 in the end region 34 of the outer pipe 16 is shown in FIGS. 15 to 17. Here one vortex generator 22 is arranged in each interspace 40 between two adjacent lobes 36. In the exemplary embodiment shown here, the vortex generators 22 are formed as far as the end 42 of the outer pipe 16, i.e. the vortex generators 22 are in particular in line in the radial direction with the end 42 of the outer pipe 16. Contrary to the vortex generators 22 shown in FIGS. 12 to 14, the vortex generators 22 shown in FIGS. 15 to 17 do not have any outlet channels 46 at the end.

FIGS. 18 to 23 each show an exemplary embodiment of a vortex generator 22. The actual embodiment is not limited in this respect to the exemplary embodiments shown here.

Figure 18:
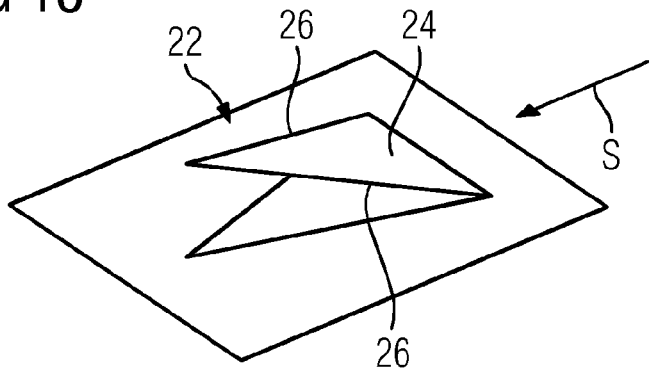
Figure 19:
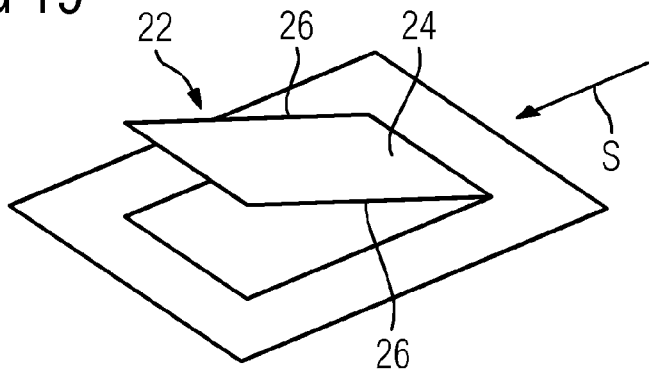
Figure 20:
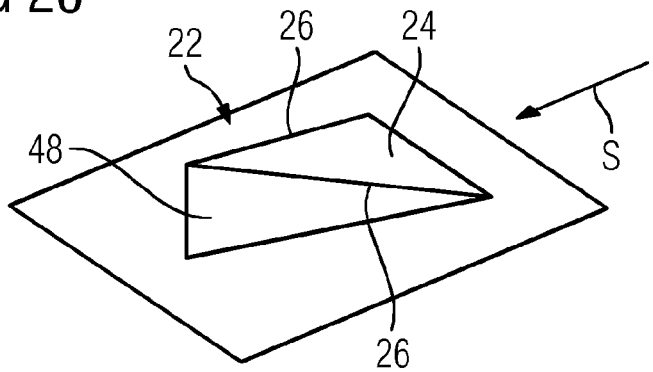
Figure 21:
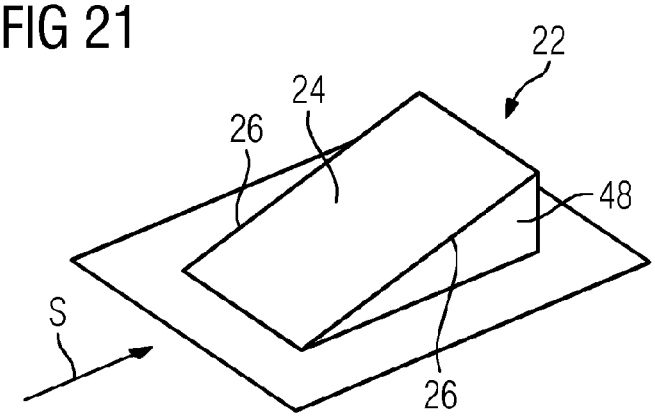
Figure 22:
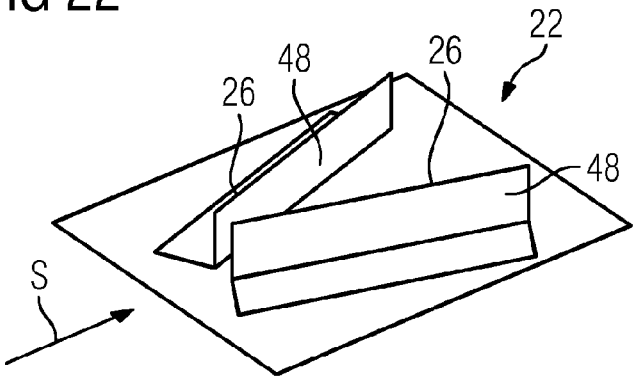
Figure 23:
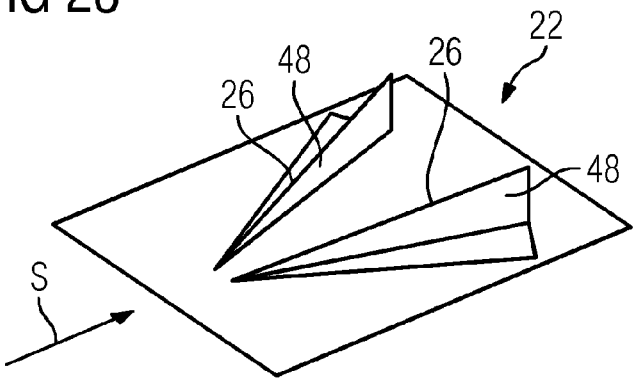

FIGS. 18 and 19 respectively show a triangular and rectangular surface 24 angled relative to a direction of flow S. FIGS. 20 and 21 show similarly configured vortex generators 22, but these are configured as solid bodies and have corresponding side faces 48. In contrast, the vortex generators 22 shown in FIGS. 22 and 23 each comprise two, in particular separately produced side faces 48, which are angled relative to the direction of flow S. In FIGS. 18 to 23 the vortex generators 22 are each oriented forwards with regard to the direction of flow S. Alternatively, however, the vortex generators 22 are oriented backwards, i.e. turned through 180° with regard to the direction of flow S (the arrow indicating direction of flow S in FIGS. 18 to 23 then points in the opposite direction).

The invention claimed is:

1. A burner, comprising:

a radially outer surface that defines an outer periphery of a premixing chamber; and a fuel nozzle for two fuels, wherein the fuel nozzle comprises: a fuel lance extending in a direction of flow into which a number of first outlet orifices for a first fuel are introduced, and the fuel lance is surrounded by an outer pipe with at least one second outlet orifice for a second fuel, wherein the number of first outlet orifices are oriented radially and the at least one second outlet orifice is oriented axially, wherein a flow cross section is formed between the fuel lance and the inside of the premixing chamber and wherein a number of vortex generators are arranged on the fuel lance which reduce the flow cross section oriented transversely of the direction of flow, wherein the radially outer surface and the outer pipe define an air flow path therebetween, wherein at least one vortex generator of the number of vortex generators is arranged upstream of the number of first outlet orifices and downstream of the at least one second outlet orifice, wherein the premixing chamber comprises a diameter and an end, and wherein a distance between the number of first outlet orifices and the end of the premixing chamber is at least three times as great as the diameter of the premixing chamber, and wherein the burner is configured such that air from the air flow path first mixes with the second fuel emanating from the at least one second outlet orifice and before being ignited the air and the second fuel then mix with the first fuel emanating from the number of first outlet orifices, after which a resulting mixture of the air, the second fuel, and the first fuel is ignited.

2. The burner as claimed in claim 1, wherein the fuel lance and the outer pipe are arranged concentrically.

3. The burner as claimed in claim 1, wherein the at least one vortex generator of the number of vortex generators comprises a wedge-shaped configuration.

4. The burner as claimed in claim 1, wherein a second vortex generator is mounted on the outer pipe.

5. The burner as claimed in claim 1, wherein a second vortex generator is arranged downstream of the number of first outlet orifices.

6. The burner as claimed in claim 1, wherein a second vortex generator is mounted on the radially outer surface of the premixing chamber.

7. The burner as claimed in claim 1, wherein the outer pipe comprises an end region which is configured as a lobe mixer and comprises a number of lobes.

8. The burner as claimed in claim 7, wherein the number of lobes are configured as lobe vortex generators.

9. The burner as claimed in claim 7, wherein the at least one vortex generator of the number of vortex generators is circumferentially aligned with an interspace between two lobes of the number of lobes.

10. A gas turbine having a burner as claimed in claim 1.

11. A burner, comprising:

a radially outer surface that defines an outer periphery of a premixing chamber; a fuel lance extending in a direction of flow and comprising plural first outlet orifices for a first fuel; an outer pipe which surrounds the fuel lance; at least one second outlet orifice formed between the fuel lance and the outer pipe for a second fuel; an air flow path between the radially outer surface and the outer pipe; and at least one vortex generator disposed on the fuel lance between the at least one second outlet orifice and the plural first outlet orifices, wherein the plural first outlet orifices are configured to inject the first fuel radially and the at least one second outlet orifice is located upstream of the plural first outlet orifices and configured to eject the second fuel axially, wherein the burner is configured such that air from the air flow path and the second fuel mix, and before being ignited, the second fuel and the first fuel then mix together in the premixing chamber to form a mixture that is then ignited.

12. The burner as claimed in claim 11, wherein the radially outer surface of the premixing chamber defines a diameter of the premixing chamber, and wherein a distance between the plural first outlet orifices and a downstream end of the premixing chamber is at least three times as great as the diameter of the premixing chamber.

13. The burner as claimed in claim 12, wherein the at least one vortex generator reduces a flow area between the fuel lance and the radially outer surface relative to a flow area between the fuel lance and the radially outer surface at a location upstream of the at least one vortex generator.

* * * * *